US007662052B1

(12) United States Patent
Vidrine

(10) Patent No.: US 7,662,052 B1
(45) Date of Patent: Feb. 16, 2010

(54) BATTING TRAINING DEVICE

(76) Inventor: Ted C. Vidrine, 720 Saint Andrews La., Keller, TX (US) 76248

( * ) Notice: Subject to any disclaimer, the term of this patent is extended or adjusted under 35 U.S.C. 154(b) by 175 days.

(21) Appl. No.: 12/026,878

(22) Filed: Feb. 6, 2008

(51) Int. Cl.
*A63B 69/00* (2006.01)

(52) U.S. Cl. ..... 473/422; 473/417

(58) Field of Classification Search ..... 473/417, 473/422, 451, 452, 453, 457, 450, 458, 266, 473/270; 273/348, 407
See application file for complete search history.

(56) References Cited

U.S. PATENT DOCUMENTS 4,886,267 A * 12/1989 Licciardi et al. ..... 473/417
5,029,852 A * 7/1991 Gilfillan ..... 473/417
5,087,039 A * 2/1992 Laseke ..... 473/417
5,386,986 A 2/1995 Gamboa
5,478,070 A * 12/1995 Morrison ..... 473/419
5,595,384 A * 1/1997 Hardison, Jr. ..... 473/453
6,579,195 B2 * 6/2003 Lamb ..... 473/417
6,666,781 B1 * 12/2003 Illis ..... 473/453
6,878,077 B2 * 4/2005 Andrews ..... 473/453
6,916,256 B1 * 7/2005 Buster et al. ..... 473/451
2005/0288120 A1 * 12/2005 Brescia ..... 473/266

* cited by examiner

*Primary Examiner*—Mitra Aryanpour
(74) *Attorney, Agent, or Firm*—Bracewell & Giuliani LLP

(57) ABSTRACT

A batting trainer has a stand with an upright post. A guide bar having forward and rearward ends is mounted to an upper end of the post between its forward and rearward ends. The guide bar being inclined relative to the post. A generally C-shaped ball support is mounted to a forward portion of and extends laterally outward from the guide bar. A tee is mounted to and extends upward from a lower portion of the ball support for supporting a ball. A tether is secured to an upper portion of the ball support for connection to the ball. A leg support bar extends laterally from the guide bar for contact by a forward leg of the batter.

17 Claims, 2 Drawing Sheets

BATTING TRAINING DEVICE

FIELD OF THE INVENTION

This invention relates generally to devices for training athletes in sports involving swinging, particularly to a training device to improve batting skills in baseball.

BACKGROUND OF THE INVENTION

One of the most difficult athletic skills to acquire is to consistently good hitting in baseball. A variety of training devices are available to aid batters. For example, automatic pitching machines may be used throw balls to a batter. Coaches may observe a batter during practice and offer suggestions. A good swing requires considerable coordination and precise positioning during the swing of the batter's legs, torso, and arms. A need exists for a device that causes the batter to practice his swing with the correct body movements.

SUMMARY OF THE INVENTION

The training device of this invention has a stand having an upright post. A guide bar is mounted to an upper end of and is inclined relative to the post. A ball support is mounted to a forward portion of the guide bar for supporting a ball to be struck by a batter. A leg position or support bar is mounted to the forward portion of the guide bar and extends laterally therefrom for contact by a forward leg of the batter. The batter swings along and a few inches above the guide bar. The guide bar results in a desired inclination of the swing.

The ball support preferably has a tee for supporting the ball. Also, in the preferred embodiment, an arm portion extends above the tee. A tether is connected to the arm portion for securing to the ball.

DETAILED DESCRIPTION OF THE INVENTION

Figure 1:
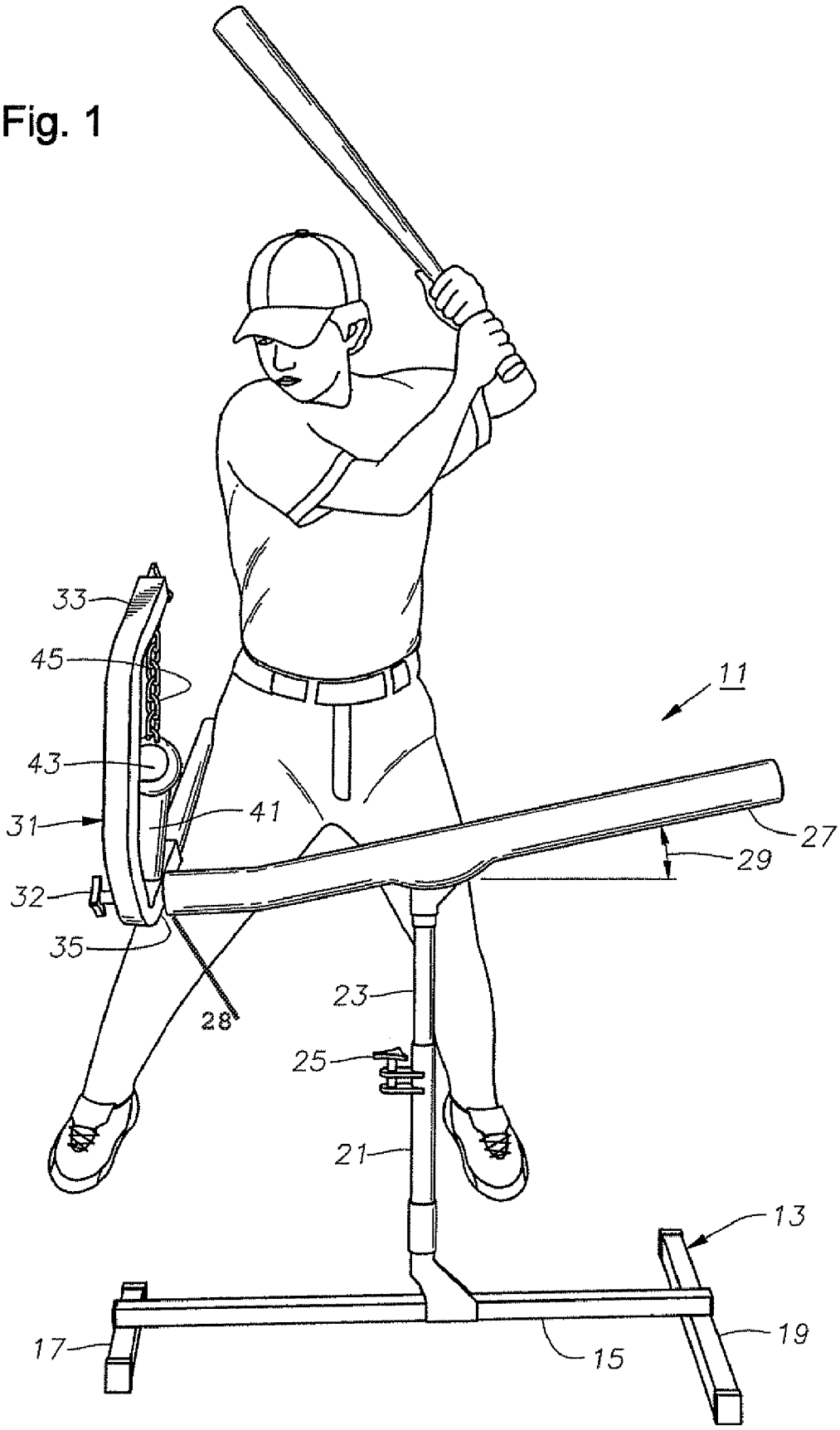
FIG. 1 is a perspective view of a batting training device constructed in accordance with this invention.
Figure 2:
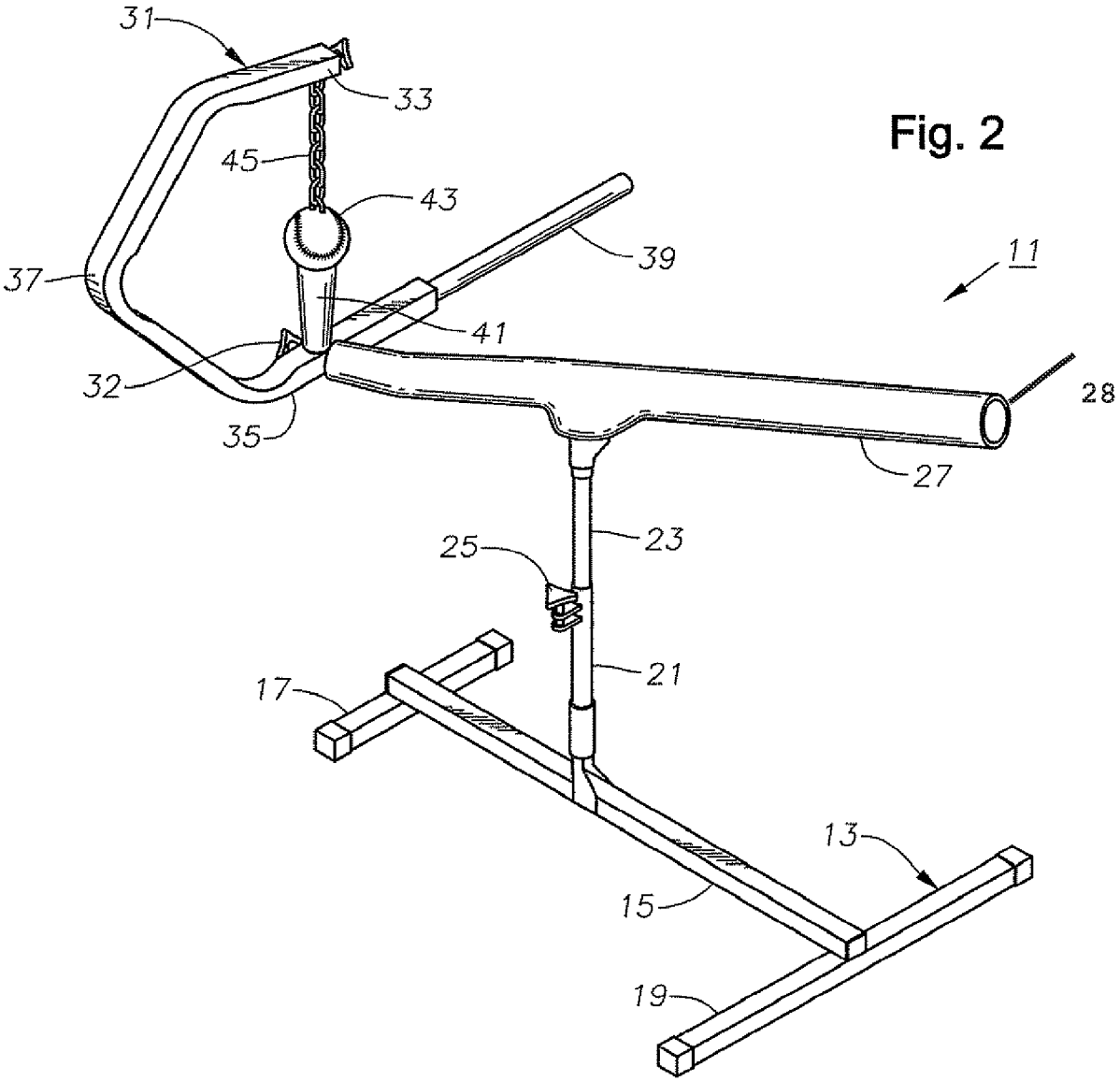
FIG. 2 is another perspective view of the batting training device of FIG. 1.

Referring to the drawings, batting training device 11 has a stand 13 for support on a horizontal ground surface. Stand 13 may have a variety of configurations. In this embodiment, stand 13 comprises a longitudinal beam 15 and two transverse beams 17, 19. Transverse beams 17, 19 are located at opposite ends of longitudinal beam 15 and are perpendicular to longitudinal beam 15. Longitudinal beam 15 joins each transverse beam 17, 19 midway between the ends of beams 17, 29. Transverse beams 17, 19 engage the ground or floor, and longitudinal beam 15 will be spaced above by the thickness of beams 17, 19. In this embodiment, rear transverse beam 19 is longer than front transverse beam 17.

A telescoping base member or post 21 is mounted to longitudinal beam 15 approximately half-way between transverse beams 17, 19. Telescoping base member 21 comprises a tube that extends vertically upward from stand 13. An upper section 23 slides telescopingly into base member 21. An adjustment knob 25 allows a user to adjust the height of telescoping upper section 23 above stand 13.

A midpoint of a guide bar 27 is mounted to the upper end of telescoping upper section 23. Guide bar 27 extends approximately the length of longitudinal beam 15 and is located in a vertical plane that also contains longitudinal beam 15. Guide bar 27 is tilted downward from the rearward end to the front end. The amount of tilt is selected to be at the approximate desired swing angle. In this embodiment, tilt angle 29 is approximately 10 degrees relative to horizontal.

A ball support bar 31 is mounted transversely to the forward end of guide bar 27. Ball support bar 31 is secured by a fastener 32 that may be readily released by a user. Ball support bar 31 has an upper arm 33 that is substantially horizontal. A lower arm 35 is spaced vertically below upper arm 33. Arms 33, 35 are parallel to each other and connected by a curved brace segment 37 on one side. Ball support bar 31 is located in a vertical plane that is intersected by guide bar 27.

A leg position bar 39 joins the end of lower arm 35 opposite curved segment 37. Leg position bar 39 extends horizontally outward in a direction opposite from curved segment 37. In the preferred embodiment, leg position bar 39 extends farther from angle bar 27 than curved portion 37, but this difference could be eliminated. Leg position bar 39 extends in a direction perpendicular to longitudinal beam 15.

A tee 41 with a conical upper end mounts to lower arm 35 and extends upward a short distance from lower arm 35. Tee 41 has an upper end configured to support a baseball or softball 43. Preferably, ball 43 is retained by a tether 45 that may be a chain. While on tee 41, ball 43 is located slightly below the midpoint between lower and upper arms 35, 33 in this embodiment.

In operation, a left-hand batter positions himself as shown in FIG. 1. The user's front leg between the knee and hip will be in contact with leg position bar 39. The user swings the bat generally along the angle of guide bar 27 but a few inches above guide bar 27 when striking ball 43. The plane of the swing should match the angle of the guide bar 27 and be about the height of ball tee 41 above guide bar 27. The tip of the bat will pass inward from curved segment 37 during the swing. The bat swings between lower and upper arms 35, 33, striking ball 43. If ball 43 is tethered by tether 45 as indicated, it will swing around upper arm 33. To change device 11 for use with a right-handed batter, the user loosens fastener 32 and pivots ball support 31 180 degrees.

In the preferred embodiment, stand 13, guide bar 27 and ball support bar 31 are formed of square tubing, but could be made from other types of beams. Preferably, a cushion covering 28 is employed over guide bar 27 to cushion any impacts in case the user accidentally strikes the bar.

The trainer facilitates batter training by forcing the batter to swing in a desired plane. The leg support bar keeps the batter from over striding and lunging forward. The trainer can be adjusted for different sizes of batters.

While the invention is shown in only one of its forms, it should be apparent to those skilled in the art that it is not so limited, but is susceptible to various changes without departing from the scope of the invention.

The invention claimed is:

1. A batting trainer, comprising:

a stand having an uptight post;

a guide bar mounted to an upper end of the post, the guide bar being inclined relative to the post;

a ball support mounted to a forward portion of the guide bar for supporting a ball to be struck by a batter;

a leg support bar mounted to the forward portion of the guide bar and extending laterally therefrom for contact by a forward leg of the batter;

a tee for supporting the ball;

an arm portion extending above the tee; and a tether connected to the arm portion for securing to the ball.

2. The trainer according to claim 1, wherein the ball support comprises:

a support member having a lower arm portion attached to and transverse to the forward portion of the guide bar, an upper arm portion located above the lower arm portion, and a curved portion joining the lower and upper arm portions and extending laterally outward from the guide bar to accommodate the swing of the bat; and a tether secured to the upper arm portion for connection to the ball.

3. The trainer according to claim 1, wherein the ball support comprises:

a support member having a lower arm portion attached to and transverse to the forward portion of the guide bar, an upper arm portion located above the lower arm portion, and a brace portion joining the lower and upper arm portions and extending laterally outward from the guide bar to accommodate the swing of the bat;

a tee mounted to and extending upward from the lower arm portion for supporting the ball; and a tether secured to the upper arm portion for connection to the ball.

4. The trainer according to claim 3, wherein the leg support bar extends laterally outward from the lower arm portion in a direction opposite to the brace portion.

5. The trainer according to claim 3, wherein the upper and lower arm portions are parallel with each other.

6. The trainer according to claim 3, wherein the upper and lower arm portions are located within a vertical plane.

7. The trainer according to claim 3, wherein the leg support bar is coaxial with the lower arm portion.

8. The trainer according to claim 1, wherein the guide bar is covered with a cushion material.

9. A batting trainer, comprising:

a stand having an upright post;

a guide bar having forward and rearward ends and mounted to an upper end of the post between its forward and rearward ends, the guide bar being inclined relative to the post;

a ball support mounted to a forward portion of the guide bar for supporting a ball to be struck by a batter, the ball support having an upper arm portion and a lower arm portion;

a tee mounted to and extending upward from the lower arm portion for supporting the ball; and a tether secured to the upper arm portion for connection to the ball.

10. The trainer according to claim 9, farther comprising a leg support bar mounted to the lower arm portion and extending laterally therefrom for contact by a forward leg of the batter.

11. The trainer according to claim 9, wherein the upper arm portion and the lower arm portion are parallel to each other.

12. The trainer according to claim 9, wherein the ball support farther comprises a curved portion joining the upper and lower arm portions on a side of the guide bar opposite the leg support bar.

13. The trainer according to claim 9, wherein the upper and lower arm portions are located within the same vertical plane.

14. The trainer according to claim 9, wherein the leg support bar is coaxial with the lower arm portion.

15. The trainer according to claim 1, wherein the guide bar is covered with a cushion material.

16. A batting trainer, comprising:

a stand having an upright post;

a guide bar having forward and rearward ends and mounted to an upper end of the post between its forward and rearward ends, the guide bar being inclined relative to the post;

a generally C-shaped ball support mounted to a forward portion of and extending laterally outward from the guide bar;

a tee mounted to and extending upward from a lower portion of a ball support for supporting a ball;

a tether secured to an upper portion of the ball support for connection to the ball; and a leg support bar extending laterally from the guide bar for contact by a forward leg of the batter.

17. The trainer according to claim 16, wherein the ball support is within a single plane.

* * * * *